US007041012B2

(12) United States Patent
Iwami et al.

(10) Patent No.: US 7,041,012 B2
(45) Date of Patent: May 9, 2006

(54) GOLF BALL

(75) Inventors: Satoshi Iwami, Kobe (JP); Takashi Sasaki, Kobe (JP); Takahiro Sajima, Kobe (JP)

(73) Assignee: Sri Sports Limited, Kobe (JP)

( * ) Notice: Subject to any disclaimer, the term of this patent is extended or adjusted under 35 U.S.C. 154(b) by 47 days.

(21) Appl. No.: 10/875,320

(22) Filed: Jun. 25, 2004

(65) Prior Publication Data

US 2005/0085318 A1 Apr. 21, 2005

(30) Foreign Application Priority Data

Sep. 16, 2003 (JP) ..... 2003-322707

(51) Int. Cl.
*A63B 37/12* (2006.01)

(52) U.S. Cl. ..... 473/378; 473/383

(58) Field of Classification Search ..... 473/378–385, 473/367, 368
See application file for complete search history.

(56) References Cited

U.S. PATENT DOCUMENTS

| | | | | |
|---|---|---|---|---|
| 5,292,132 | A | 3/1994 | Oka | |
| 5,872,185 | A | 2/1999 | Ichikawa et al. | |
| 6,241,627 | B1 * | 6/2001 | Kasashima et al. | 473/384 |
| 6,624,221 | B1 | 9/2003 | Takesue et al. | |
| 6,855,071 | B1 * | 2/2005 | Endo et al. | 473/355 |
| 2002/0155903 | A1 * | 10/2002 | Kato et al. | 473/371 |
| 2003/0050138 | A1 * | 3/2003 | Kasashima | 473/384 |

* cited by examiner

*Primary Examiner*—Raeann Gorden
(74) *Attorney, Agent, or Firm*—Birch,Stewart,Kolasch & Birch,LLP

(57) ABSTRACT

A golf ball 2 has a core 4, a cover 6, and numerous dimples 8. This cover 6 is composed of a resin composition which includes a thermoplastic styrene elastomer and an ionomer resin as principle components. A melt index of this resin composition at 190° C. is equal to or greater than 4.0 g/10 min. Ratio R1 of the diameter $d_{max}$ of the maximum dimple to the diameter D of the golf ball 2 is 10.5% or greater and 17.0% or less. A ratio R2 of the number of dimples 8 having a diameter d accounting for 10.5% or greater and 17.0% or less of the diameter D of the golf ball 2, occupied in total number N of the dimples is equal to or greater than 20%. Shore D hardness of the cover 6 is 50 or greater and 63 or less.

15 Claims, 7 Drawing Sheets

GOLF BALL

This application claims priority on patent application No. 2003-322707 filed in Japan on Sep. 16, 2003.

BACKGROUND OF THE INVENTION

1. Field of the Invention

The present invention relates to golf balls. More particularly, the present invention relates to golf balls having a core and a cover, with dimples being formed on the cover.

2. Description of the Related Art

General golf balls have a core and a cover. There exist the cores composed of a single solid rubber layer, those composed of two or more solid rubber layers, those composed of a solid rubber layer and a synthetic resin layer, and the like.

Numerous dimples are formed on the surface of the cover. A role of the dimples involves causing turbulent flow separation through disrupting the air flow around the golf ball during the flight. By causing the turbulent flow separation, a separating point of air from the golf ball shifts backwards leading to the reduction of a drag coefficient. The turbulent flow separation promotes the differentia between the separating points at the upper and lower sides of the golf ball, which result from the backspin, thereby enhancing the lift force that acts upon the golf ball.

A variety of dimples to which improvement of the flight performance is intended have been proposed. For example, improvement in connection with the number, area, volume, the cross-sectional shape and the like of dimples has been attempted (see. U.S. Pat. No. 5,292,132).

For the formation of a cover, injection molding or compression molding has been employed. In either case of the molding, a molten resin composition flows in the space between a cavity face of a mold and a core. When the flow is insufficient, failures such as air residual, bare, off-center of the core and the like are caused. A variety of resin compositions to which improvement of the fluidity (i.e., formability) is intended have been proposed. For example, U.S. Pat. No. 6,624,221 discloses a resin composition for a cover including a thermoplastic elastomer and a wax blended. U.S. Pat. No. 5,872,185 discloses a resin composition including an ionomer resin and a thermoplastic styrene elastomer blended.

Control performances are also important for golf balls. The control performance correlates with a spin performance. Great back spin rate results in small run (a distance from the position where the golf ball dropped to a position where it stopped). For golf players, golf balls which are liable to be spun backwards are apt to be rendered to stop at a targeted position. High side spin rate results in possibility of curving of the golf ball. For golf players, golf balls which are liable to be side spun are apt to be rendered to intentionally curve. Senior golf players particularly place great importance on control performances when the golf ball is hit by a short iron.

As described above, the back spin results in generation of a lift force. Although the lift force is necessary for the flight performances of a golf ball, excess lift force may rather shorten the flight distance by contrast. Particularly, when the lift force that acts on a golf ball which is flying at a high speed following impact with a driver is too great, hopping of the golf ball is provided, leading to significant reduction of the flight distance. An object of the present invention is to provide a golf ball which is excellent in formability, a control performance and a flight performance.

SUMMARY OF THE INVENTION

A golf ball according to the present invention has a core, a cover and numerous dimples formed on the surface of this cover. This cover comprises a resin composition including a thermoplastic styrene elastomer. Melt index of this resin composition at 190° C. is equal to or greater than 4.0 g/10 min. A ratio R1 of the diameter $d_{max}$ of the maximum dimple to the diameter D of the golf ball is 10.5% or greater and 17.0% or less. According to this golf ball, failure hardly occurs during formation of the cover. According to this golf ball, the styrene elastomer is responsible for the spin performance (i.e., control performance). This golf ball is also excellent in the flight performance. Although detailed grounds for the excellent flight performance of this golf ball are uncertain, it is speculated that the maximum dimple leads to suppression of the lift force to be excessive in the high speed area.

Preferably, a ratio R2 of the number of dimples having a diameter d accounting for 10.5% or greater and 17.0% or less of the diameter D of the golf ball, occupied in total number N of the dimples is equal to or greater than 20%.

Preferably, a base polymer of the resin composition comprises a thermoplastic styrene elastomer and an ionomer resin as principle components. Shore D hardness of the cover comprising this resin composition is 50 or greater and 63 or less.

Preferably, thickness of the cover is 1.0 mm or greater and 1.8 mm or less. Preferably, total number N of the dimples is 150 or greater and 360 or less.

DESCRIPTION OF THE PREFERRED EMBODIMENTS

The present invention is hereinafter described in detail with appropriate references to the accompanying drawing according to the preferred embodiments of the present invention.

Figure 1:
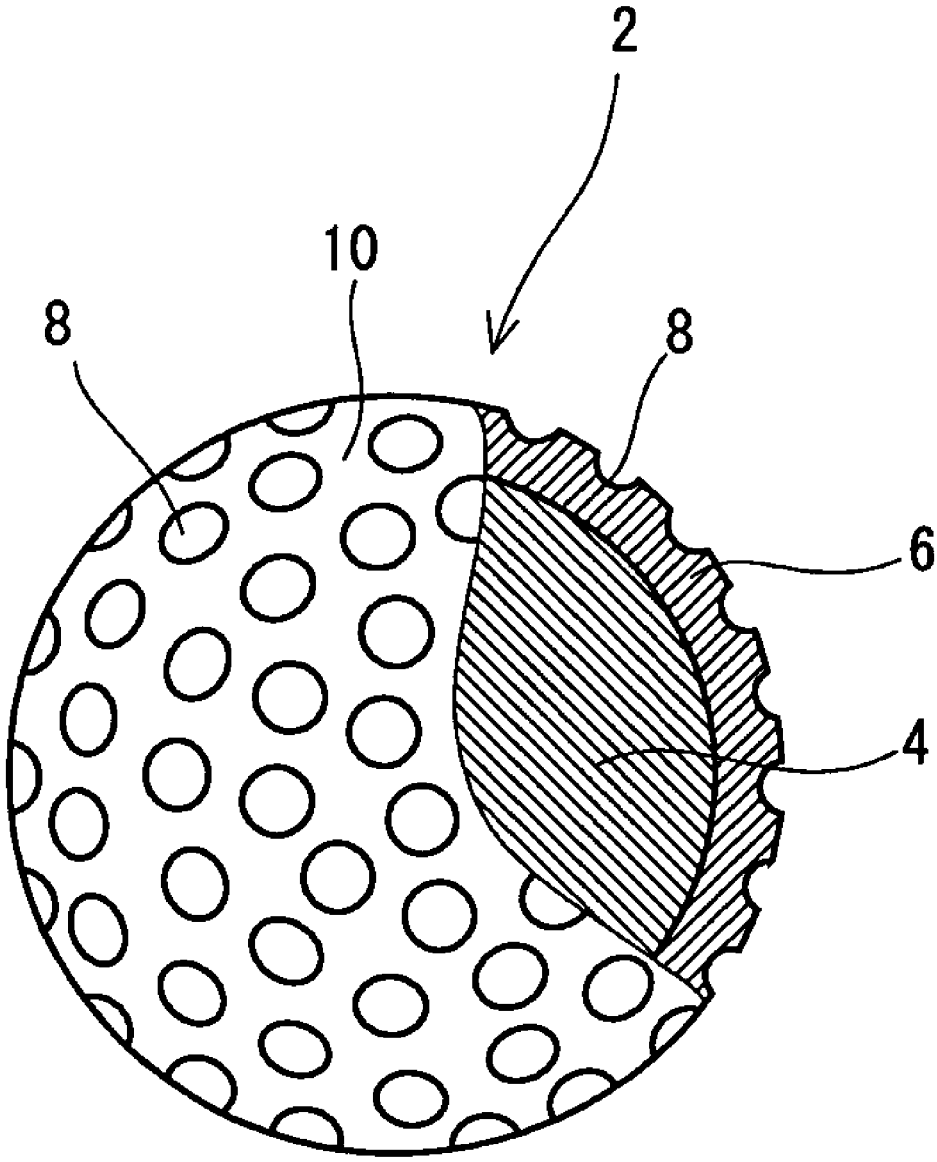
FIG. 1 is a schematic cross-sectional view illustrating a golf ball according to one embodiment of the present invention.

A golf ball 2 depicted in FIG. 1 has a spherical core 4 and a cover 6. Numerous dimples 8 are formed on the surface of the cover 6. Of the surface of the cover 6, a part except for the dimples 8 is a land 10. Although this golf ball 2 has a paint layer and a mark layer to the external side of the cover 6, these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of reduction of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is formed through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking of the core 4, a co-crosslinking agent is usually used. Preferable examples of the co-crosslinking agent in light of the resilience performance include zinc acrylate, magnesium acrylate, zinc methacrylate and magnesium methacrylate. In the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, sulfur, an anti-aging agent, a coloring agent, a plasticizer, a dispersant and the like may be blended at an appropriate amount to the rubber composition as needed. Crosslinked rubber powder or synthetic resin powder may be blended to the rubber composition.

The core 4 has a diameter of 30.0 mm or greater and 42.0 mm or less, and particularly of 38.0 mm or greater and 41.5 mm or less. The core 4 may be composed of two or more layers.

The cover 6 herein means an outermost layer except for the paint layer and mark layer. There exist golf balls referred to as having a cover with a double layer structure, and in this instance, the outer layer corresponds to the cover 6 herein.

The cover 6 comprises a thermoplastic resin composition. This resin composition includes a thermoplastic styrene elastomer as a base polymer. This thermoplastic styrene elastomer accelerates the spin rate of the golf ball 2, and improves the control performance of the same. In light of the control performance, proportion of the thermoplastic styrene elastomer occupied in the entire base polymer is preferably equal to or greater than 5% by weight, and particularly preferably equal to or greater than 10% by weight. In light of the resilience performance and durability of the golf ball 2, the proportion is preferably equal to or less than 50% by weight, and particularly preferably equal to or less than 30% by weight.

Thermoplastic styrene elastomers contain a styrene block as a hard segment within the molecule thereof. Examples of the thermoplastic styrene elastomer include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS include styrene-ethylene-butylene-styrene block copolymers (SEBS). Exemplary hydrogenated SIS include styrene-ethylene-propylene-styrene block copolymers (SEPS). Exemplary hydrogenated SIBS include styrene-ethylene-ethylene-propylene-styrene block copolymers (SEEPS).

According to the present invention, polymer alloys of an olefin with a thermoplastic elastomer containing a styrene block are also referred to as "thermoplastic styrene elastomer". The olefin component in the polymer alloy is speculated to be responsible for the improvement of miscibility with other base polymer. Through the use of this polymer alloy, the resilience performance of the golf ball 2 is improved. For the polymer alloy, an olefin having the carbon atoms of 2 or more and 10 or less is used. Illustrative examples of suitable olefin include ethylene, propylene, butene and tenpene. Ethylene and propylene are particularly preferred. Specific examples of the polymer alloy include "Rabalon®SJ4400N", "Rabalon®SJ5400N", "Rabalon® SJ6400N", "Rabalon® SJ7400N", "Rabalon® SJ8400N", "Rabalon® SJ9400N" and "Rabalon® SR04", all of which are trade names from Mitsubishi Chemical Corporation.

In the cover 6, other polymer may be used in combination with the thermoplastic styrene elastomer. Illustrative examples of suitable polymer include ionomer resins, thermoplastic polyurethane elastomers, thermoplastic polyamide elastomers, thermoplastic polyester elastomers and thermoplastic polyolefin elastomers.

It is particularly preferred that an ionomer resin is used in combination with the thermoplastic styrene elastomer. The ionomer resin is responsible for the resilience performance and durability of the golf ball 2. In light of the resilience performance and durability, weight ratio of the ionomer resin and the thermoplastic styrene elastomer is preferably equal to or greater than 60/40, and particularly preferably equal to or greater than 80/20. In light of the control performance, the weight ratio is preferably equal to or less than 95/5, and particularly preferably equal to or less than 90/10. Proportion of total amount of the ionomer resin and the thermoplastic styrene elastomer occupied in the entire base polymer is preferably equal to or greater than 60% by weight, and particularly preferably equal to or greater than 80% by weight.

In light of the formability, ionomer resins having a melt index (MI) at 190° C. of equal to or greater than 4.0 g/10 min are preferred, and ionomer resins having MI of equal to or greater than 5.0 g/10 min are particularly preferred. The melt index of generally available ionomer resins is equal to or less than 20.0 g/10 min. Specific examples of preferable ionomer rein include the following products.

Du Pont-MITSUI POLYCHEMICALS Co., Ltd.
Trade name "Himilan 1555" MI: 10.0 g/10 min
Trade name "Himilan 1557" MI: 5.0 g/10 min
Trade name "Himilan 1652" MI: 5.0 g/10 min
Trade name "Himilan 1702" MI: 14.0 g/10 min
Trade name "Himilan 1705" MI: 5.0 g/10 min.
DuPont
Trade name "Surlyn® 8945" MI: 4.8 g/10 min
Trade name "Surlyn® 9945" MI: 5.2 g/10 min.

Melt index of the resin composition at 190° C. is equal to or greater than 4.0 g/10 min. This resin composition is excellent in formability. In light of the formability, the melt index is more preferably equal to or greater than 4.5 g/10 min, and particularly preferably equal to or greater than 5.0 g/10 min. Generally, the melt index of the resin composition is equal to or less than 20.0 g/10 min. The melt index is a flow rate of a resin composition under the load of 2.16 kgf for 10 minutes. The melt index is measured with "Melt Indexer", trade name from Toyo Seiki Seisaku-Sho, Ltd.

To the resin composition may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be blended with powder of a highly dense metal such as tungsten, molybdenum or the like for the purpose of adjusting the specific gravity.

Hardness of the cover 6 is 50 or greater and 63 or less. When the hardness is less than the above range, flight distance of the golf ball 2 may be insufficient due to excessive spin. In this respect, the hardness is more preferably equal to or greater than 53, and particularly preferably equal to or greater than 55. When the hardness is beyond the above range, unsatisfactory feel at impact and durability of the golf ball 2 insufficient may be provided. In this respect, the hardness is particularly preferably equal to or less than 60. Hardness is measured in accordance with a standard of "ASTM-D 2240-68", with an automated rubber hardness scale which is equipped with a Shore D type spring hardness scale (trade name "LA1", available from Koubunshi Keiki Co., Ltd.). For the measurement, a sheet having a thickness of about 2 mm and consisting of the same material as the cover 6 is used. Prior to the measurement, the sheet is stored at the temperature of 23° C. for two weeks. Upon the measurement, three sheets are overlaid.

Thickness of the cover 6 is preferably 1.0 mm or greater and 1.8 mm or less. This cover 6 is relatively thin. Although failures are liable to occur upon formation of a thin cover 6, such failures can be suppressed through the use of the aforementioned resin composition. When the thickness is less than the above range, difficulty may be involved in formation of the cover 6 even though the aforementioned resin composition is used. In this respect, the thickness is more preferably equal to or greater than 1.2 mm, and particularly preferably equal to or greater than 1.4 mm. When the thickness is beyond the above range, the resilience performance and durability of the golf ball 2 may become insufficient. In this respect, the thickness is more preferably equal to or less than 1.6 mm. The cover 6 is formed by injection molding or compression molding.

Figure 2:
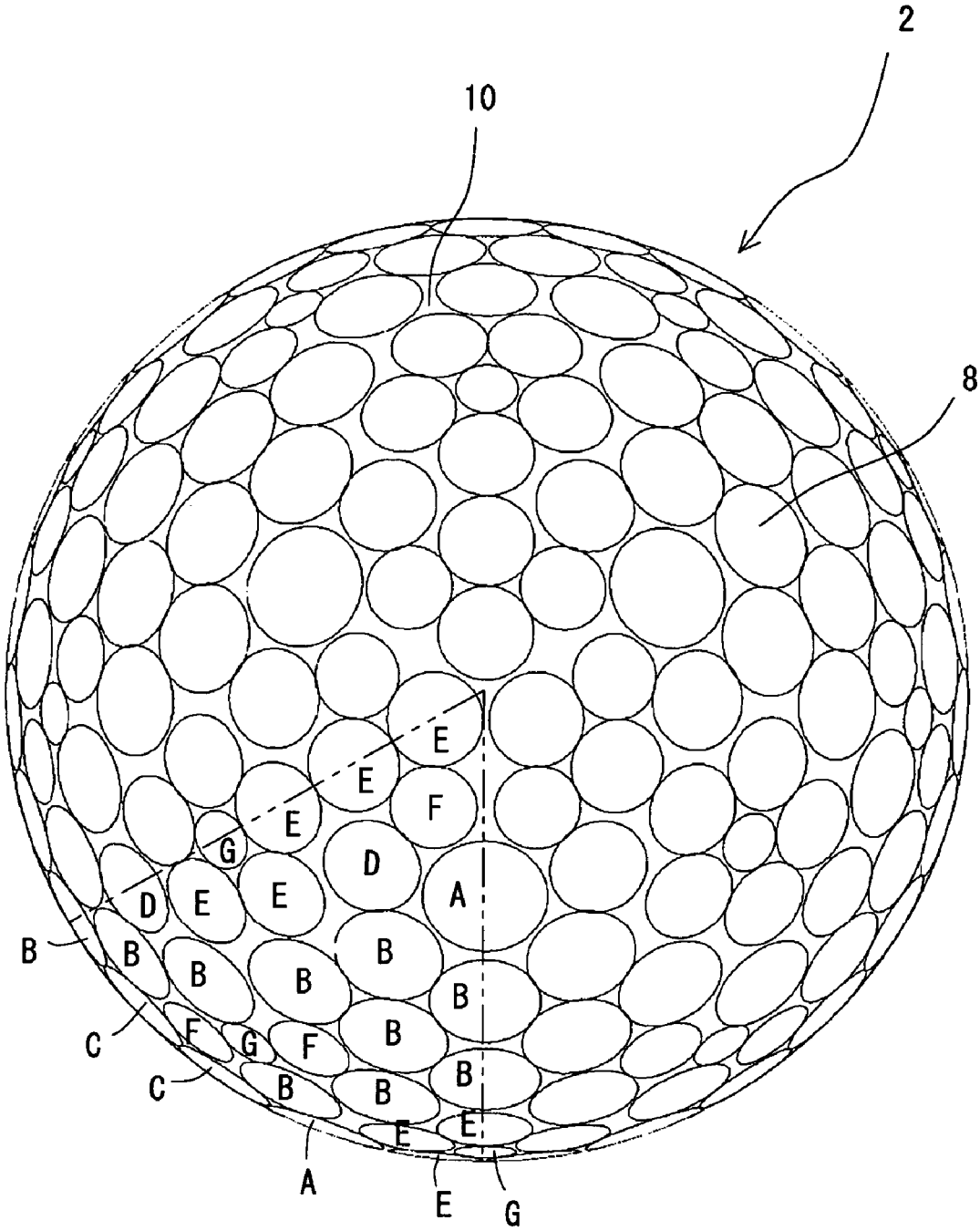
FIG. 2 is an enlarged plan view illustrating the golf ball shown in FIG. 1.

FIG. 2 is an enlarged plan view illustrating the golf ball 2 shown in FIG. 1. As is clear from FIG. 2, plane shape of all the dimples 8 is circular. This golf ball 2 has dimples A having a diameter of 5.60 mm, dimples B having a diameter of 5.10 mm, dimples C having a diameter of 4.90 mm, dimples D having a diameter of 4.50 mm, dimples E having a diameter of 4.30 mm, dimples F having a diameter of 3.90 mm, and dimples G having a diameter of 2.80 mm. The number of the dimples A is 18; the number of the dimples B is 102; the number of the dimples C is 24; the number of the dimples D is 18; the number of the dimples E is 72; the number of the dimples F is 36; and the number of the dimples G is 24. Total number N of the dimples of this golf ball 2 is 294.

The maximum dimple herein means a dimple 8 having the largest diameter. In instances of a non-circular dimple, a circular dimple 8 having the same area with that of the non-circular dimple is envisioned, and the diameter of this circular dimple 8 is assumed as the diameter of the non-circular dimple. The maximum dimple of the golf ball 2 depicted in FIG. 2 is the dimple A. In other words, the diameter $d_{max}$ of the maximum dimple is 5.60 mm. The ratio R1 of the diameter $d_{max}$ of the maximum dimple (in this instance, 5.60 mm) to the diameter D of the golf ball 2 (in this instance, 42.67 mm) is 13.1%.

In this golf ball 2, the ratio R1 is great in comparison with those of conventional golf balls 2. In other words, the maximum dimple is significantly large. This maximum dimple leads to suppression of the excessive lift force in the high speed area. According to this golf ball 2, hopping is suppressed by the maximum dimple irrespective of the great spin rate resulting from the soft cover 6. This golf ball 2 achieves both of the formability and the flight performance. In light of the aerodynamic characteristics, the ratio R1 is set to be equal to or greater than 10.5%. The ratio R1 is more preferably equal to or greater than 12.0%, and particularly preferably equal to or greater than 13.0%. When the ratio R1 is too great, fundamental feature of the golf ball 2 which is a substantially spherical body may be compromised, leading to deteriorated flight performance, or leading to difficulty in rolling of the golf ball 2 on the green. In this respect, the ratio R1 is preferably equal to or less than 17.0%, more preferably equal to or less than 16.0%, and particularly preferably equal to or less than 15.0%.

The dimple 8 having a diameter d accounting for 10.5% or greater and 17.0% or less of the diameter D of the golf ball 2 is responsible for improvement of the aerodynamic characteristics of the golf ball 2. The ratio R2 of the number of dimples 8 having a diameter d accounting for 10.5% or greater and 17.0% or less of the diameter D of the golf ball 2, occupied in total number N of the dimples is preferably equal to or greater than 20%. The golf ball 2 having the ratio R2 of equal to or greater than 20% is excellent in the flight performance. In this respect, the ratio R2 is more preferably equal to or greater than 22%, and particularly preferably equal to or greater than 30%. The ratio R2 is ideally 100%.

In light of the flight performance, it is preferred that all of the dimples 8 have the diameter d accounting for equal to or greater than 5.0%, further equal to or greater than 5.5%, and particularly equal to or greater than 5.8% of the diameter D of the golf ball 2.

Figure 3:
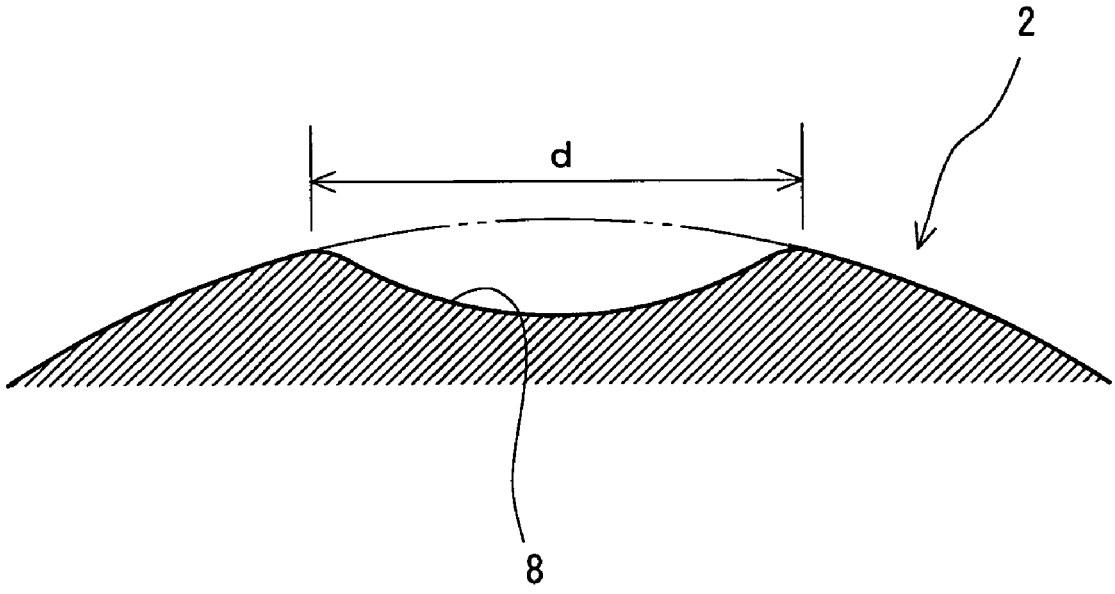
FIG. 3 is a schematic enlarged cross-sectional view illustrating a part of the golf ball shown in FIG. 1.

FIG. 3 is a schematic enlarged cross-sectional view illustrating apart of the golf ball 2 shown in FIG. 1. In this Figure, across-section traversing the deepest part of the dimple 8 is depicted. What is indicated by a both-sided arrowhead d in this Figure is a diameter of the dimple 8. This diameter d is a distance between both contact points when common tangent lines are depicted at both edges of the dimple 8. Further, volume of a space surrounded by a phantom sphere (a sphere provided when it was postulated that there is no dimple 8 existed, and is depicted by a chain double-dashed line in FIG. 3) of the golf ball 2 and the surface of the dimple 8 is the dimple volume.

The area of the dimple 8 is an area of a region surrounded by the contour of the dimple 8 when the center of the golf ball 2 is viewed at infinity (i.e., an area of the plane shape). In instance of a circular dimple 8, the area s is calculated by the following formula.

$$s=(d/2)^2\cdot\pi$$

In the golf ball 2 shown in FIG. 2, the area s of the dimple A is 24.63 $mm^2$; the area s of the dimple B is 20.43 $mm^2$; the area s of the dimple C is 18.86 $mm^2$; the area s of the dimple D is 15.90 $mm^2$; the area s of the dimple E is 14.52 $mm^2$; the area s of the dimple F is 11.95 $mm^2$; and the area s of the dimple G is 6.15 $mm^2$. Accordingly, a summation S of the dimple areas s is 4889.3 $mm^2$ in this golf ball 2. Ratio of this total area S to the surface area of the phantom sphere is a surface area occupation ratio Y. According to this golf ball 2, the surface area occupation ratio Y is 85.5%. It is preferred that the surface area occupation ratio Y is 75% or greater and 88% or less.

Total number N of the dimples 8 is preferably 150 or greater and 360 or less. When the total number N is less the above range, fundamental feature of the golf ball 2 which is a substantially spherical body may be compromised. In this respect, the total number N is more preferably equal to or greater than 180. When the total number N is beyond the above range, the ratio R1 of equal to or greater than 10.5% is hardly achieved. In this respect, the total number N is more preferably equal to or less than 350, and particularly preferably equal to or less than 340.

Summation of the dimple volume is preferably 400 $mm^3$ or greater and 800 $mm^3$ or less. When the total volume is less than the above range, a hopping trajectory may be provided. In this respect, the total volume is more preferably equal to or greater than 450 $mm^3$, and particularly preferably equal to or greater than 500 $mm^3$. When the total volume is beyond the above range, a dropping trajectory may be provided. In this respect, the total volume is more preferably equal to or less than 770 $mm^3$, and particularly preferably equal to or less than 750 $mm^3$.

Although the dimples 8 to be formed may be of only one type, it is preferred that two or more types, particularly three or more types of the dimples 8 having different diameter or depth are formed, in light of the flight performance. In stead of the circular dimples 8, or together with the circular dimples 8, non-circular dimples may be also formed. Specific examples of the non-circular dimple include polygonal dimples, elliptical dimples, oval dimples, egg-shaped dimples and the like.

The amount of compressive deformation of the golf ball 2 is preferably 2.5 mm or greater and 3.5 mm or less. When the amount of compressive deformation is less than the above range, hopping of the golf ball 2 may be achieved due to the excessive spin. In this respect, the amount of compressive deformation is more preferably equal to or greater than 2.7 mm, and particularly preferably equal to or greater than 2.9 mm. When the amount of compressive deformation is beyond than the above range, heavy feel at impact may be experienced. In this respect, the amount of compressive deformation is more preferably equal to or less than 3.3 mm, and particularly preferably equal to or less than 3.2 mm. Upon measurement of the amount of compressive deformation, the golf ball 2 that a subject for the measurement is first placed on a hard plate made of metal. Next, a cylinder made of metal gradually descends toward the golf ball 2. The golf ball 2 which is intervened between the bottom face of the cylinder and the hard plate is deformed. A migration distance of the cylinder, starting from the state in which initial load of 98 N is applied to the golf ball up to the state in which final load of 1274 N is applied thereto is the amount of compressive deformation.

Figure 4:
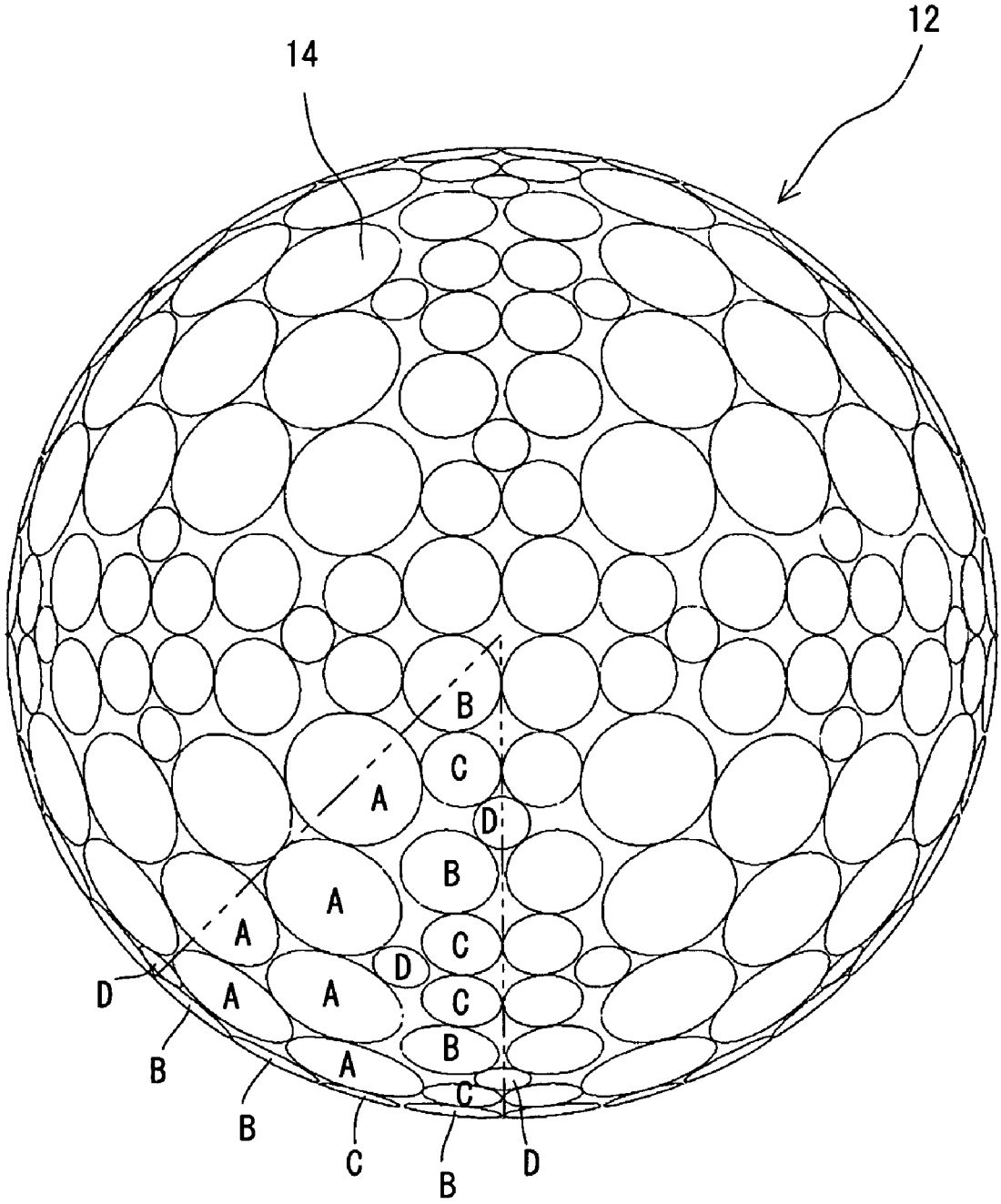
FIG. 4 is a plan view illustrating a golf ball according to other embodiment of the present invention.

FIG. 4 is a plan view illustrating a golf ball 12 according to other embodiment of the present invention. This golf ball 12 has numerous dimples 14. As is clear from FIG. 4, plane shape of all the dimples 14 is circular. This golf ball 12 has dimples A having a diameter of 6.20 mm, dimples B having a diameter of 4.30 mm, dimples C having a diameter of 3.50 mm, and dimples D having a diameter of 2.50 mm. The number of the dimples A is 80; the number of the dimples B is 88; the number of the dimples C is 80; and the number of the dimples D is 40. Total number N of the dimples of this golf ball 12 is 288.

A cover of this golf ball 12 comprises a resin composition including a thermoplastic styrene elastomer. The melt index of this resin composition at 190° C. is equal to or greater than 4.0 g/10 min. In this golf ball 12, the diameter $d_{max}$ of the maximum dimple is 6.20 mm. The ratio R1 in this golf ball 12 is 14.5%. According to this golf ball, the ratio R2 of the number of dimples 14 having a diameter d accounting for 10.5% or greater and 17.0% or less of the diameter D of the golf ball 12, occupied in total number N of the dimples is 27.8%. This golf ball 12 is excellent in the formability, control performance and flight performance.

Figure 5:
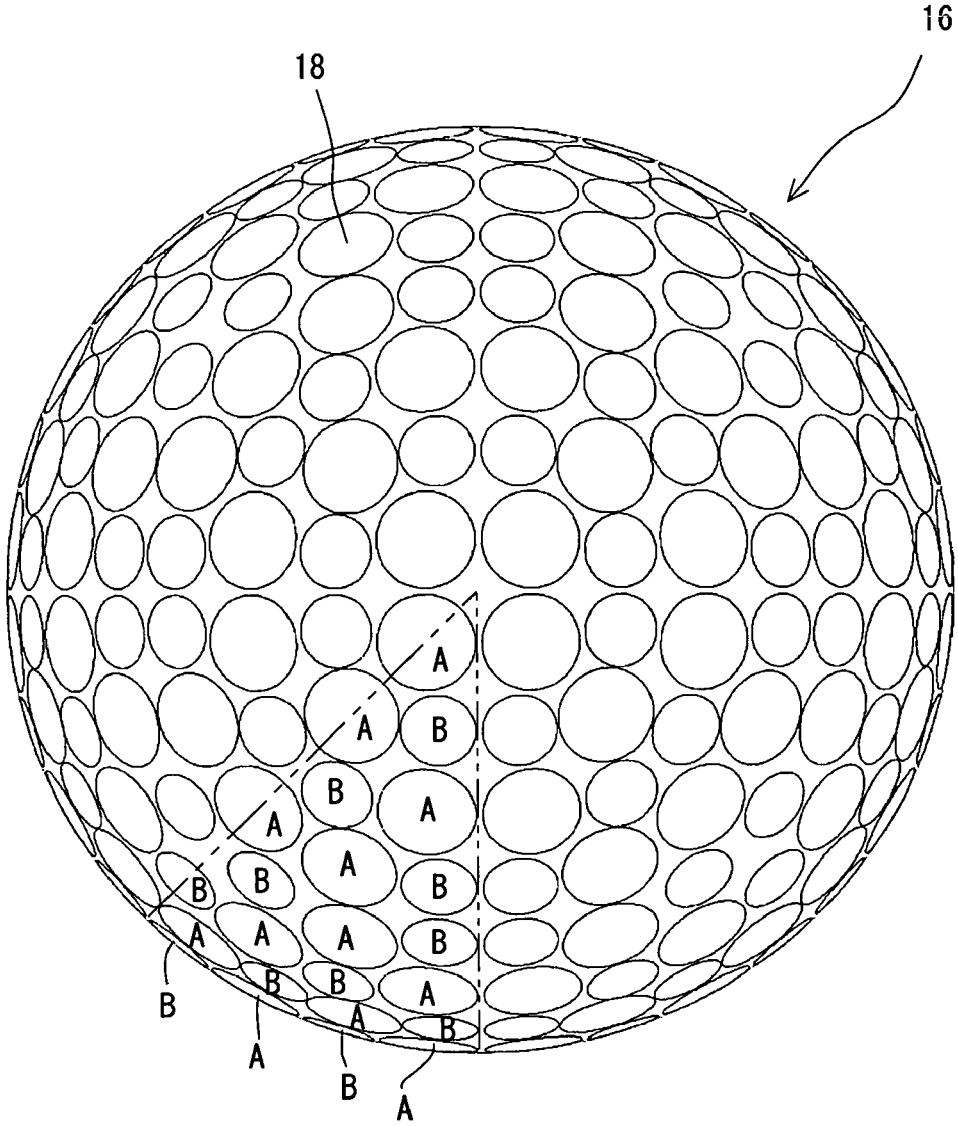
FIG. 5 is a plan view illustrating a golf ball according to still other embodiment of the present invention.

FIG. 5 is a plan view illustrating a golf ball 16 according to still other embodiment of the present invention. This golf ball 16 has numerous dimples 18. As is clear from FIG. 5, plane shape of all the dimples 18 is circular. This golf ball 16 has dimples A having a diameter of 4.50 mm, and dimples B having a diameter of 3.40 mm. The number of the dimples A is 168; and the number of the dimples B is 168. Total number N of the dimples of this golf ball 16 is 336.

A cover of this golf ball 18 comprises a resin composition including a thermoplastic styrene elastomer. Melt index of this resin composition at 190° C. is equal to or greater than 4.0 g/10 min. In this golf ball 16, the diameter $d_{max}$ of the maximum dimple is 4.50 mm. The ratio R1 in this golf ball 16 is 10.5%. According to this golf ball, the ratio R2 of the number of dimples 18 having a diameter d accounting for 10.5% or greater and 17.0% or less of the diameter D of the golf ball 16, occupied in total number N of the dimples is 50.0%. This golf ball 16 is excellent in the formability, control performance and flight performance.

EXAMPLES

Example 1

A rubber composition was obtained by kneading 100 parts by weight of polybutadiene (trade name "BR-11" available from JSR Corporation), 31 parts by weight of zinc acrylate, 5 parts of zinc oxide, 14.0 parts by weight of barium sulfate, 0.5 part by weight of diphenyl disulfide and 0.8 part by weight of dicumyl peroxide. This rubber composition was placed into a mold having upper and lower mold half each having a spherical cavity, and heated at 170° C. for 15 minutes to obtain a core having a diameter of 39.6 mm. On the other hand, a resin composition was obtained by kneading 45 parts by weight of an ionomer resin (trade name "Himilan 1555"), 45 parts by weight of another ionomer resin (trade name "Himilan 1557"), 10 parts by weight of a thermoplastic styrene elastomer (trade name "Rabalon® SR04") and 3 parts of titanium oxide. The aforementioned core was placed into a mold having numerous protrusions on the inside face, followed by injection of the aforementioned resin composition around the core to form a cover having a thickness of 1.6 mm. Numerous dimples having a shape inverted from the shape of the protrusion were formed on the cover. Paint was applied on this cover to give the golf ball of Example 1 having a diameter of 42.7 mm. Specifications of dimples of this golf ball are as type I presented in Table 4 below.

Examples 2 to 3 and Comparative Examples 1 to 2

In a similar manner to Example 1 except that the mold was changed to alter specifications of the dimples, golf balls of Examples 2 to 3 and Comparative Examples 1 to 2 were obtained. Specifications of the dimples are presented in Table 1 and Table 4 below.

Examples 4 to 5 and Comparative Examples 3 to 4

In a similar manner to Example 1 except that materials of the cover were changed, golf balls of Examples 4 to 5 and Comparative Examples 3 to 4 were obtained. Specifications of the cover are presented in Table 1 and Table 3 below.

Example 6

In a similar manner to Example 1 except that materials of the core were changed, a golf ball of Example 6 was obtained. Specifications of the core are presented in Table 1 and Table 2 below.

[Travel Distance Test]

A driver with a metal head (tradename "XXIO"available from Sumitomo Rubber Industries, Ltd., shaft hardness: S, loft angle: 10°) was equipped with a swing machine available from True Temper Co. Then the machine condition was set to give the head speed of 45 m/sec, and golf balls were hit therewith. Accordingly, launch angle, spin rate immediately after the impact, carry (i.e., the distance from the launching point to the point where the ball dropped) and total travel distance (i.e., the distance from the launching point to the point where the ball stopped) were measured. Mean values of 5 times measurement are shown in Table 1 below.

[Evaluation of Formability]

Two hundred golf balls were formed, and whether or not insufficient filling of the resin composition occurs was visually evaluated. The results are presented in Table 1 below.

TABLE 3

Specifications of cover

| Type | a | b | c | d | e |
|---|---|---|---|---|---|
| Ionomer resin 1555 ※4 | 45 | 40 | — | — | 50 |
| Ionomer resin 1557 ※5 | 45 | 40 | — | — | 50 |
| Ionomer resin 1605 ※6 | — | — | — | 45 | — |
| Ionomer resin 1706 ※7 | — | — | — | 45 | — |
| Ionomer resin 8945 ※8 | — | — | 45 | — | — |
| Ionomer resin 9945 ※9 | — | — | 45 | — | — |
| Thermoplastic styrene elastomer ※10 | 10 | 20 | 10 | 10 | — |
| Titanium dioxide | 3 | 3 | 3 | 3 | 3 |
| MI at 190° C. (g/10 min) | 6.0 | 5.2 | 4.2 | 1.3 | 7.5 |
| Hardness (Shore D) | 57 | 52 | 59 | 60 | 60 |

※4 Binary ionomer neutralized with sodium "Himilan 1555" available from Du Pont-MITSUI POLYCHEMICALS Co., Ltd.
※5 Binary ionomer neutralized with zinc "Himilan 1557" available from Du Pont-MITSUI POLYCHEMICALS Co., Ltd.
※6 Binary ionomer neutralized with sodium "Himilan 1605" available from Du Pont-MITSUI POLYCHEMICALS Co., Ltd.
※7 Binary ionomer neutralized with zinc "Himilan 1706" available from Du Pont-MITSUI POLYCHEMICALS Co., Ltd.
※8 Binary ionomer neutralized with sodium "Surlyn. 8945" available from DuPont
※9 Binary ionomer neutralized with zinc "Surlyn. 9945" available from DuPont
※10 "Rabalon. SR04" available from Mitsubishi Chemical Corporation

TABLE 1

Specifications and evaluation results of golf ball

| | | Example 1 | Example 2 | Example 3 | Comp. Example 1 | Comp. Example 2 | Example 4 | Example 5 | Comp. Example 3 | Comp. Example 4 | Example 6 |
|---|---|---|---|---|---|---|---|---|---|---|---|
| Core | Type | x | x | x | x | x | x | x | x | x | y |
| Cover | Type | a | a | a | a | a | b | c | d | e | a |
| | Thermoplastic styrene elastomer (weight %) | 10 | 10 | 10 | 10 | 10 | 20 | 10 | 10 | 0 | 10 |
| | MI (° C./min) | 6.0 | 6.0 | 6.0 | 6.0 | 6.0 | 5.2 | 4.2 | 1.3 | 7.5 | 6.0 |
| | Hardness (Shore D) | 57 | 57 | 57 | 57 | 57 | 52 | 59 | 60 | 60 | 57 |
| Dimple | Type | I | II | III | IV | V | I | I | I | I | I |
| | Ratio R1 (%) | 13.1 | 14.5 | 10.5 | 10.1 | 9.6 | 13.1 | 13.1 | 13.1 | 13.1 | 13.1 |
| | Ratio R2 (%) | 55.1 | 27.8 | 50.0 | 0.0 | 0.0 | 55.1 | 55.1 | 55.1 | 55.1 | 55.1 |
| Amount of Compressive deformation (mm) | | 2.94 | 2.94 | 2.94 | 2.94 | 2.94 | 3.02 | 2.83 | 2.75 | 2.78 | 3.21 |
| Launch angle (degree) | | 11.5 | 11.5 | 11.5 | 11.5 | 11.5 | 11.5 | 11.6 | 11.6 | 11.4 | 11.6 |
| Spin rate (rpm) | | 2700 | 2700 | 2700 | 2700 | 2700 | 2780 | 2670 | 2800 | 2500 | 2600 |
| Carry (m) | | 218 | 217 | 216 | 213 | 213 | 216 | 219 | 216 | 213 | 218 |
| Total distance (m) | | 225 | 224 | 224 | 221 | 221 | 224 | 226 | 224 | 220 | 226 |
| Formability | | Good | Good | Good | Good | Good | Good | Good | Bad | Good | Good |

TABLE 2

Specifications of core

| Type | x | y |
|---|---|---|
| High cis-polybutadiene ※1 | 100.0 | 100.0 |
| Zinc diacrylate | 31.0 | 29.0 |
| Zinc oxide | 5.0 | 5.0 |
| Barium sulfate | 14.0 | 14.8 |
| Diphenyl disulfide ※2 | 0.5 | 0.5 |
| Dicumyl peroxide ※3 | 0.8 | 0.8 |
| Crosslinking temperature(° C.) | 170 | 170 |
| Crosslinking time(min) | 15 | 15 |
| Diameter of core(mm) | 39.6 | 39.6 |
| Amount of Compressive deformation(mm) | 3.3 | 3.7 |

※1 Trade name "BR18" from JSR Corporation
※2 Manufactured by Sumitomo Seika Chemicals Co., Ltd.
※3 Manufactured by NOF Corporation

TABLE 4

Specifications of dimples

| Type | Kind | Number | Ratio (%) | Diameter (mm) | Ratio R1 (%) | Ratio R2 (%) | Total number N | Plan view |
|---|---|---|---|---|---|---|---|---|
| I | A | 18 | 6.1 | 5.60 | 13.1 | 55.1 | 294 | FIG. 2 |
| | B | 102 | 34.7 | 5.10 | | | | |
| | C | 24 | 8.2 | 4.90 | | | | |
| | D | 18 | 6.1 | 4.50 | | | | |
| | E | 72 | 24.5 | 4.30 | | | | |
| | F | 36 | 12.2 | 3.90 | | | | |
| | G | 24 | 8.2 | 2.80 | | | | |
| II | A | 80 | 27.8 | 6.20 | 14.5 | 27.8 | 288 | FIG. 4 |
| | B | 88 | 30.6 | 4.30 | | | | |
| | C | 80 | 27.8 | 3.50 | | | | |
| | D | 40 | 13.9 | 2.50 | | | | |

TABLE 4-continued

Figure 6:
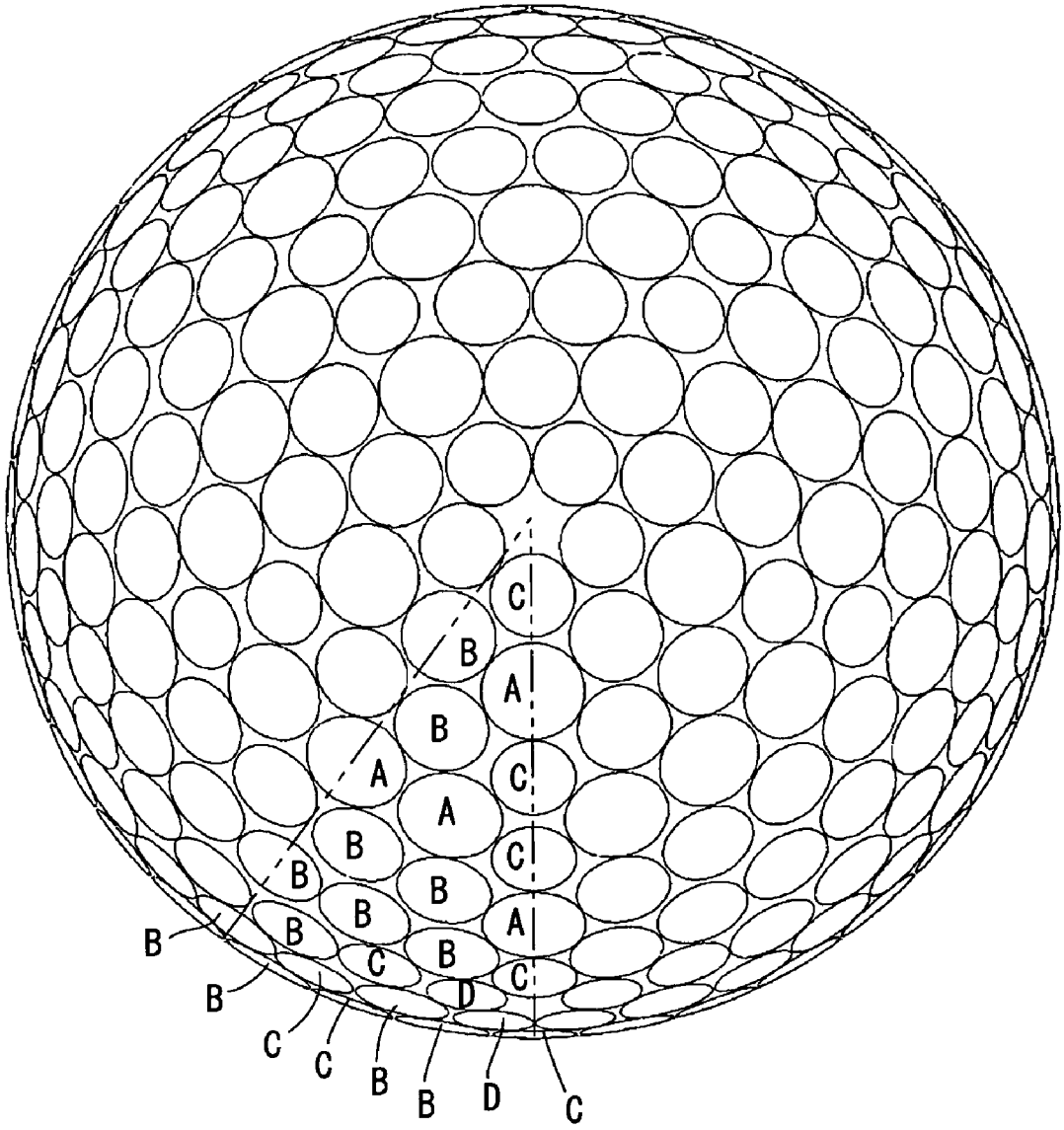
FIG. 6 is a plan view illustrating a golf ball according to Comparative Example 1.
Figure 7:
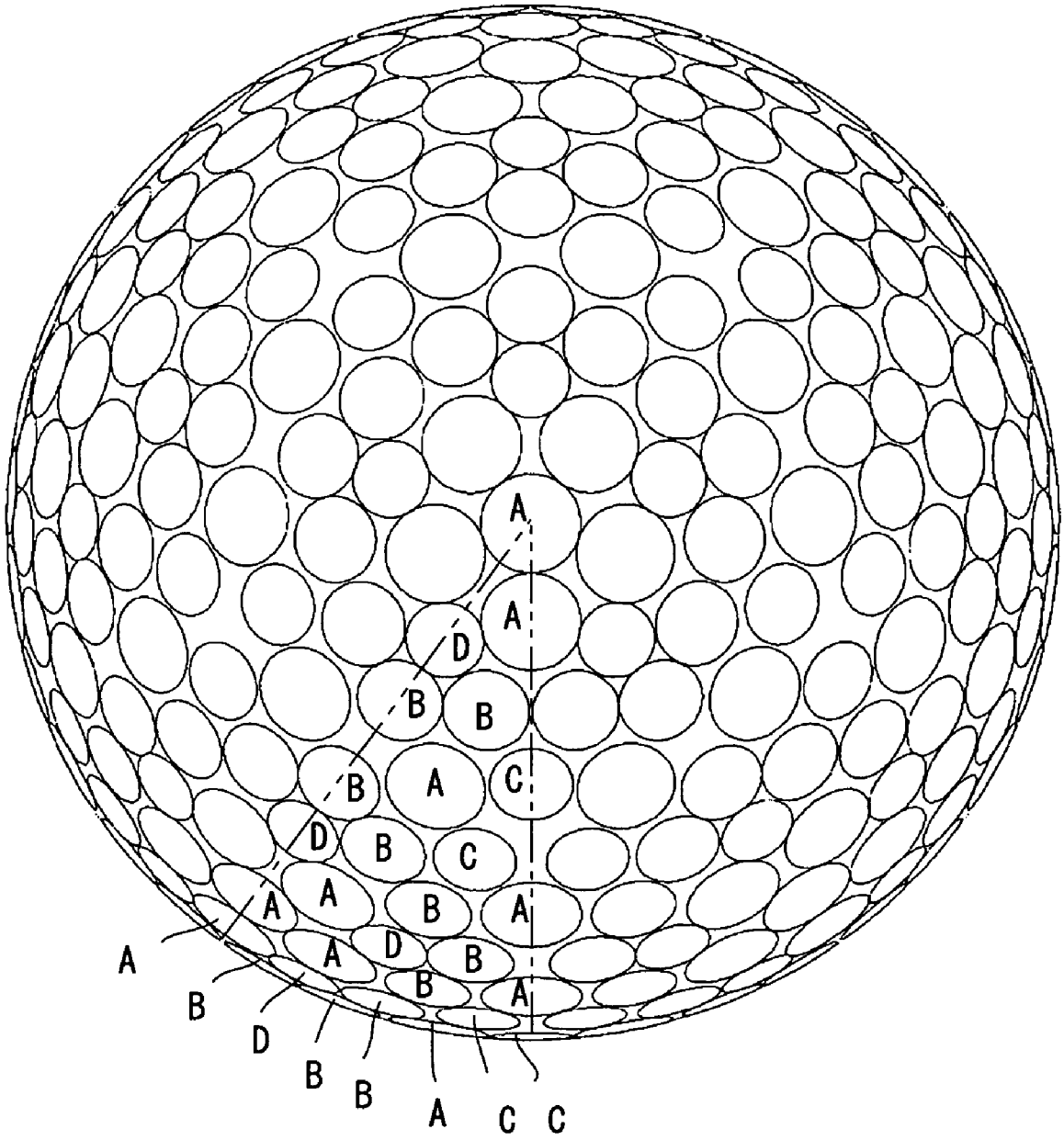
FIG. 7 is a plan view illustrating a golf ball according to Comparative Example 2.

| Specifications of dimples | | | | | | | | |
|---|---|---|---|---|---|---|---|---|
| Type | Kind | Number | Ratio (%) | Diameter (mm) | Ratio R1 (%) | Ratio R2 (%) | Total number N | Plan view |
| III | A | 168 | 50.0 | 4.50 | 10.5 | 50.0 | 336 | FIG. 5 |
| | B | 168 | 50.0 | 3.40 | | | | |
| IV | A | 50 | 12.2 | 4.30 | 10.1 | 0.0 | 410 | FIG. 6 |
| | B | 210 | 51.2 | 3.90 | | | | |
| | C | 110 | 26.8 | 3.50 | | | | |
| | D | 40 | 9.8 | 3.30 | | | | |
| V | A | 132 | 30.6 | 4.10 | 9.6 | 0.0 | 432 | FIG. 7 |
| | B | 180 | 41.7 | 3.60 | | | | |
| | C | 60 | 13.9 | 3.40 | | | | |
| | D | 60 | 13.9 | 3.30 | | | | |

As is shown in Table 1, golf balls of Examples are excellent in the spin performance, flight performance and formability. Accordingly, advantages of the present invention are clearly indicated by these results of evaluation.

The description herein above is anyhow just for one example, and therefore, various modifications can be made without departing from the principles of the present invention. The present invention can be applied to golf balls composed of three or more layers.

What is claimed is:

1. A golf ball having a core, a cover, and numerous dimples formed on the surface of said cover, wherein said cover comprises a resin composition which includes a thermoplastic styrene elastomer, a melt index of said resin composition at 190° C. is equal to or greater than 4.0 g/10min., and a ratio R1 of the diameter $d_{max}$ of the maximum dimple to the diameter D of the golf ball is 10.5% or greater and 17.0% or less.

2. The golf ball according to claim 1 wherein a ratio R2 of the number of dimples having a diameter d accounting for 10.5% or greater and 17.0% or less of said diameter D, with respect to the total number N of the dimples is equal to or greater than 20%.

3. The golf ball according to claim 1 wherein a base polymer of said resin composition comprises a thermoplastic styrene elastomer and an ionomer resin as principle components, and the Shore D hardness of said cover is 50 or greater and 63 or less.

4. The golf ball according to claim 1 wherein the thickness of said cover is 1.0 mm or greater and 1.8 mm or less.

5. The golf ball according to claim 1 wherein a total number N of the dimples is 150 or greater and 360 or less.

6. The golf ball according to claim 2 wherein a total number N of the dimples is 150 or greater and 360 or less.

7. The golf ball according to claim 1 wherein said resin composition of said cover comprises an ionomer resin and a thermoplastic styrene elastomer within a weight ratio range of 60/40 to 95/5.

8. The golf ball according to claim 1 wherein said resin composition of said cover comprises an ionomer resin and a thermoplastic styrene elastomer within a weight ratio range of 80/20 to 90/10.

9. The golf ball according to claim 1 wherein the melt index of said resin composition at 190° C. is equal to or greater than 5.0 g/10 mm. and equal to or less than 20.0 g/10 min.

10. The golf ball according to claim 1 wherein the ratio R1 is equal to or greater than 12.0% and equal to or less than 16.0%.

11. The golf ball according to claim 1 wherein the ratio R1 is equal to or greater than 13.0% and equal to or less than 15.0%.

12. The golf ball according to claim 1 wherein a ratio R2 of the number of dimples having a diameter d accounting for 10.5% or greater and 17.0% or less of said diameter D, with respect to the total number N of the dimples is equal to or greater than 22%.

13. The golf ball according to claim 1 wherein a ratio R2 of the number of dimples having a diameter d accounting for 10.5% or greater and 17.0% or less of said diameter D, with respect to the total number N of the dimples is equal to or greater than 30%.

14. The golf ball according to claim 1 wherein all of the dimples have a diameter d accounting for equal to or greater than 5.0% of the diameter D of the golf ball.

15. The golf ball according to claim 1 wherein all of the dimples have a diameter d accounting for equal to or greater than 5.8% of the diameter D of the golf ball.

* * * * *